US006921348B1

(12) United States Patent
Johnson

(10) Patent No.: US 6,921,348 B1
(45) Date of Patent: Jul. 26, 2005

(54) ARROWHEAD

(76) Inventor: Gregory G. Johnson, 3928 46th Ave. South, Minneapolis, MN (US) 55406

( * ) Notice: Subject to any disclaimer, the term of this patent is extended or adjusted under 35 U.S.C. 154(b) by 0 days.

(21) Appl. No.: 10/260,602

(22) Filed: Sep. 30, 2002

(51) Int. Cl.[7] ..... F42B 6/08
(52) U.S. Cl. ..... 473/584
(58) Field of Search ..... 473/578, 583, 473/584

(56) References Cited

U.S. PATENT DOCUMENTS

D172,196 S * 5/1954 Roper
3,756,600 A * 9/1973 Maleski ..... 473/584
3,910,579 A * 10/1975 Sprandel ..... 473/584
4,234,191 A * 11/1980 Erlandson
5,178,399 A * 1/1993 Garoutte
5,857,930 A * 1/1999 Troncoso ..... 473/583
6,217,467 B1 * 4/2001 Maleski ..... 473/583
6,270,435 B1 * 8/2001 Sodaro ..... 473/583
6,743,128 B2 * 6/2004 Liechty, II ..... 473/583

* cited by examiner

*Primary Examiner*—John A. Ricci
(74) *Attorney, Agent, or Firm*—Hugh D. Jaeger

(57) ABSTRACT

An arrowhead having interchangeable finely honed cutting blades with opposing broad ground surfaces for slicing through and into a target. Multiple blades are interchangeably secured about a tapered body.

8 Claims, 5 Drawing Sheets

ARROWHEAD

CROSS REFERENCES TO RELATED APPLICATIONS

None.

BACKGROUND OF THE INVENTION

1. Field of the Invention

The present invention is for an arrowhead, and more particularly is for an arrowhead having refined cutting blades.

2. Description of the Prior Art

Prior art arrowheads have included multiple blades which serve to enter the mass which an arrowhead impinges. Often the blade edges have had no modification or would utilize simple opposed wide-angle bevel cuts to effect a rudimentary cutting, ripping or tearing edge which forced target surfaces apart by brute force action. The lack of good slicing, piercing and parting qualities of the blades resulted in much of the force of the projectile arrow being expended in just breaking through the target surface, thereby leaving less potential energy for deep penetration. As a consequence, an effective shoot, that is, a shoot making a sufficiently deep wound entry to achieve a successful result, was difficult to attain. With the popularity of bow hunting, hunters have expanded the hunt from commonly hunted animals to larger and more challenging prey, such prey having thicker and tougher hides or skin. Against such prey, the effectiveness of prior art arrowheads is even less. Clearly, what is needed is an arrowhead offering adequate cutting qualities which would allow easier entry and deep penetration of a hunter's arrow into the target or wildlife game.

SUMMARY OF THE INVENTION

The general purpose of the present invention is to provide an arrowhead having blades with improved cutting edges.

According to the present invention, there is provided an arrowhead including a plurality of blades each having a cutting edge which has a narrow cutting angle produced by opposing broad finely ground or honed surfaces which extend inwardly a considerable distance from the outer periphery of the cutting edge toward the center of the arrowhead to effect a narrow profile sharp cutting edge. The blades are interchangeable and replaceable by the user as desired.

One significant aspect and feature of the present invention is an arrowhead which can deeply penetrate a target or wildlife game.

Another significant aspect and feature of the present invention is an arrowhead having blades which are finely ground, honed or otherwise fashioned to provide for a narrow angle cutting edge along the length of each blade.

Still another significant aspect and feature of the present invention is an arrowhead having finely fashioned blades which are cutting instruments of improved effectiveness and efficiency.

Yet another significant aspect and feature of the present invention is an arrowhead having blades which penetrate using a slicing action.

A further significant aspect and feature of the present invention is an arrowhead which slices a target or wildlife game surface instead of tearing or ripping such target or wildlife game surface, thereby expending minimal energy for initial entry and allowing remaining energy to be utilized for deep penetration into the target or wildlife game.

Having thus enumerated significant aspects and features of the present invention, it is the principal object of the present invention to provide an arrowhead having improved sharpened and profiled blades for easy entry into a target or wildlife game.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference characters designate like parts throughout the figures thereof and wherein.

DETAILED DESCRIPTION OF THE PREFERRED EMBODIMENT

Figure 1:
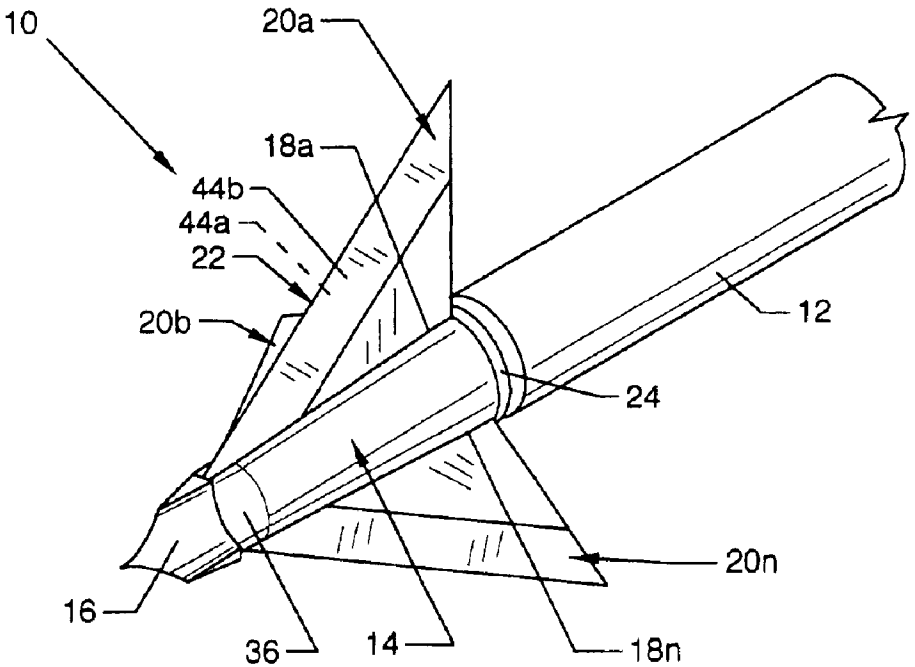
FIG. 1 is an isometric view of an arrowhead, the present invention, mounted to an arrow shaft, shown partially.

FIG. 1 is an isometric view of an arrowhead 10, the present invention, in use with and mounted to the partially shown shaft 12 of an arrow. Readily visible components of the arrowhead 10 include a body 14, which is round and partially tapered. The body 14 includes a three-sided chisel tip 16 at the most forward portion and a plurality of slots 18*a*–18*n* radially placed and extending along the length of the body 14. The slots 18*a*–18*n* fittingly accommodate a plurality of blades 20*a*–20*n* which are secured therein along and about the body 14. Each of the similarly constructed blades 20*a*–20*n* has a razor sharp cutting edge 22. A mounting ferrule 24 is located behind the rearward edges of the blades 20*a*–20*n*.

Figure 2:
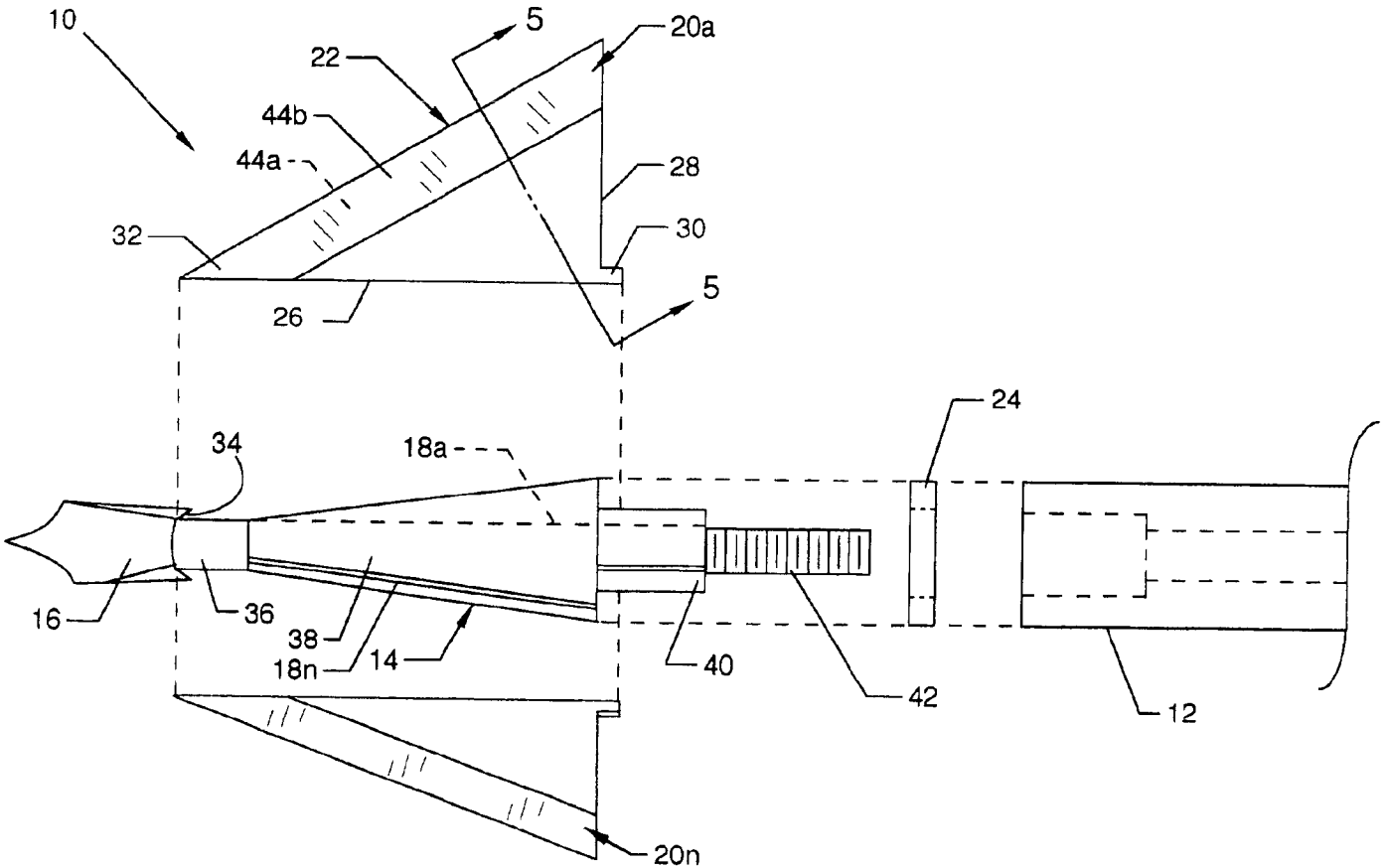
FIG. 2 is an exploded view of the arrowhead shown in relationship to the arrow shaft.

FIG. 2 is an exploded view of the arrowhead 10, the present invention, shown in relationship to the shaft 12 of an arrow. Shown in particular is the blade 20*a* which is illustrated being detached from the body 14. The blade 20*a*, being substantially triangular shaped, includes a bottom edge 26, a rear edge 28 perpendicular to the bottom edge 26, a cutting edge 22 extending between the forward portion of the bottom edge 26 and the portion of the rear edge 28 distant from the bottom edge 26, a mounting tab 30 extending rearwardly from the junction of the rear edge 28 and the bottom edge 26, and a tip 32 which is the region formed by the junction of the bottom edge 26 and the cutting edge 22. The body 14, which is of one-piece construction, includes the chisel tip 16 and also an adjoining nontapered section 36, an adjoining tapered section 38, an adjoining nontapered section 40 which is slightly larger than nontapered section 36, and an adjoining rearwardly extending threaded section 42. Slots 18*a*–18*n* extend continuously through the tapered section 38 and the nontapered section 40. The bottoms of the slots 18*a*–18*n* align with the outer surface of the nontapered section 36. The bottoms of the slots 18*a*–18*n* and the outer surface of the nontapered section 36 form continuous surfaces against which the bottom surfaces 26 of the blades 20*a*–20*n* align. Also shown is one of three undercut bevels 34 at the rearward edge of the chisel tip 16. The tip 32 and the mounting tab 30 are incorporated for securing of the blade 20*a* in the slot 18*a* as shown in FIG. 3.

Figure 3:
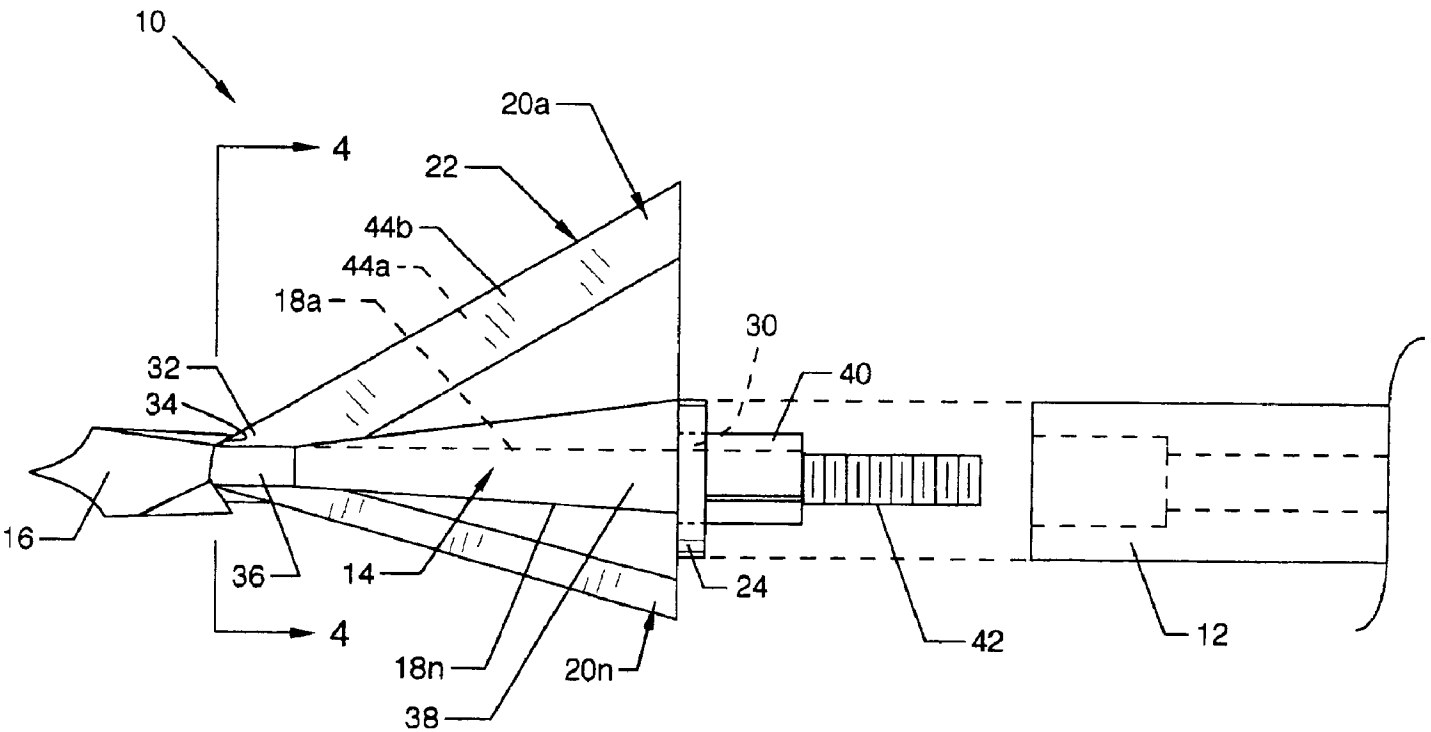
FIG. 3 is an assembled side view of the arrowhead shown in relationship to the arrow shaft.

FIG. 3 is an assembled side view of the arrowhead 10, shown in relationship to the arrow shaft 12, illustrating the mounting of the blade 20*a* to the body 14. The blade 20*a* is inserted into the slot 18*a* and then advanced to place the tip 32 beneath the undercut bevel 34. Subsequently, the mounting ferrule 24 is advanced over the nontapered section 40 to capturingly locate over and about the mounting tab(s) 30. The shaft 12 of the arrow is then threadingly engaged to the threaded section 42 of the tip 14 to maintain the mounting ferrule 24 in a position over and about the mounting tab(s) 30 against the rearward edge of the tapered section 38.

Figure 4:
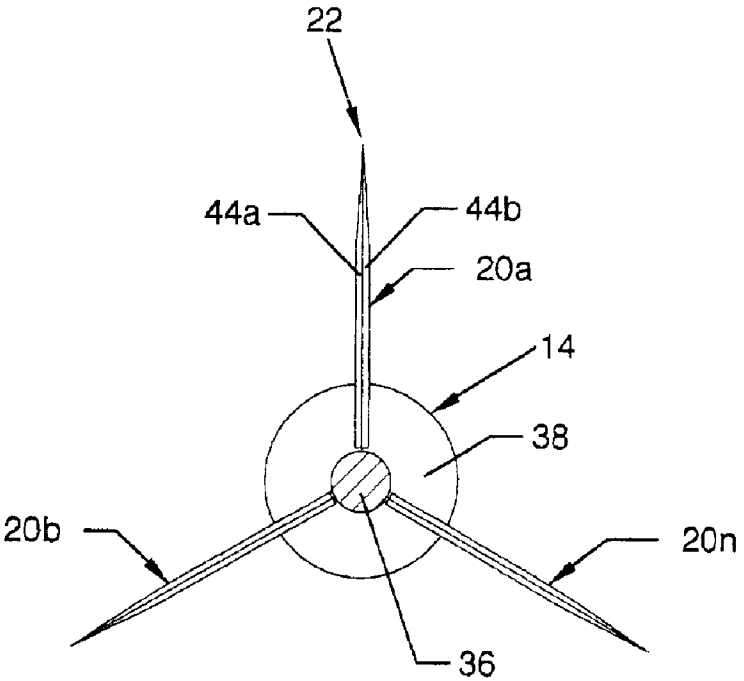
FIG. 4 is a front view of the blades of the arrowhead looking in the direction of the viewing line 4—4 of FIG. 3.

FIG. 4 is a front view of the blades 20*a*–20*n* looking in the direction of the viewing line 4—4 of FIG. 3.

Figure 6:
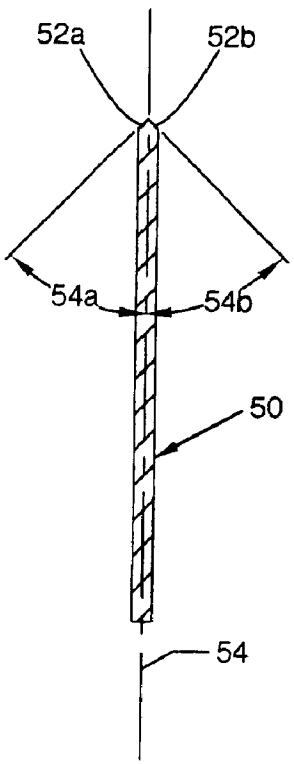
FIG. 6 PRIOR ART
Figure 5:
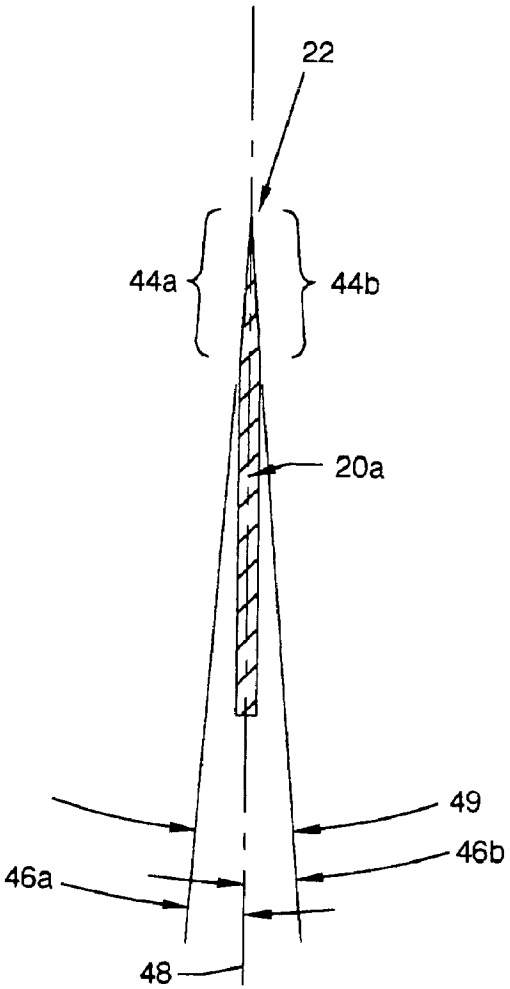
FIG. 5 is a cross section view of a blade along line 5—5 of FIG. 2; and, FIG. 6 is a cross section view of a prior art blade.

FIG. 5 is a cross section view of blade 20*a* along line 5—5 of FIG. 2. Illustrated in particular is the cutting edge 22 formed by opposing broad ground surfaces 44*a* and 44*b* which extend at equal and relatively narrow angles 46*a* and 46*b* with respect to the centerline 48 to provide a narrow-angled entry blade 20*a*. The narrow overall angle encompassed by the combination or sum of angles 46*a* and 46*b* can also be expressed as a single narrow angle 49 centered about the centerline 48. The single narrow angle 49 or the combination of the narrow angles 46*a* and 46*b* can range from 5° to 30° inclusive. The opposing broad ground surfaces 44*a* and 44*b* can be formed by precision grinding, honing or other such method incorporated to form a suitable narrow profile blade 20*a*. The opposing broad ground surfaces 44*a* and 44*b* extend inwardly a considerable distance from the outward periphery of the cutting edge 22 to present a thinly formed nonbulky profile which, it will be appreciated, provides a narrow-angled entry blade, especially when compared to a typical prior art blade 50, shown in FIG. 6, having opposing narrow ground surfaces 52*a* and 52*b* forming equal and wide angles 54*a* and 54*b* with respect to the centerline 54, which gives rise to a wide-angled entry blade.

MODE OF OPERATION

The chisel tip 16 of the arrowhead 10, the present invention, first encounters the target or wildlife game to initially create a small puncture to allow initial entry of the arrowhead 10. Subsequently, the blades 20*a*–20*n*, having cutting edges 22 formed by the opposing broad ground surfaces 44*a* and 44*b*, at an angle in a range of 5°–25°, and such as 20°, part the target or wildlife game by a slicing action as opposed to ripping or by brute force entry, such as by prior art blades 50. Such slicing action expends minimal energy for entry, thereby conserving remaining energy to be spent for carriage of the arrowhead past the initial parted surfaces and deep into the target or wildlife game.

Various modifications can be made to the present invention without departing from the apparent scope hereof.

What is claimed is:

1. An arrowhead comprising:

a. a plurality of blades each having a 20° angled cutting edge including a narrow cutting angle produced by opposing broad finely ground and/or honed surfaces which extend inwardly a considerable distance from the outer periphery of the cutting edge toward the center of the arrowhead to effect a narrow profile sharp cutting edge, and wherein the arrowhead has chisel tip with a rearward edge having a plurality of undercut bevels and each undercut bevel of the plurality of undercut bevels has a blade of the plurality of blades secured therein.

2. An arrowhead comprising:

a. a plurality of blades each having a 5°–25° angled cutting edge including a narrow cutting angle produced by opposing broad finely ground and/or honed surfaces which extend inwardly a considerable distance from the outer periphery of the cutting edge toward the center of the arrowhead to effect a narrow profile sharp cutting edge, and wherein the arrowhead has chisel tip with a rearward edge having a plurality of undercut bevels and each undercut bevel of the plurality of undercut bevels has a blade of the plurality of blades secured therein.

3. An arrow, the arrow having an arrowhead with a blade comprising:

a. an angled cutting edge including a narrow cutting angle produced by opposing broad finely ground and/or honed surfaces which extend inwardly a considerable distance from the outer periphery of the cutting edge toward the center of the arrowhead to effect a narrow profile sharp cutting edge, wherein the narrow cutting angle is from 5° to 30° inclusive, and wherein the arrowhead has chisel tip with a rearward edge having a plurality of undercut bevels and each undercut bevel of the plurality of undercut bevels has a blade of the plurality of blades secured therein.

4. The arrow of claim 3, wherein the blade is a separable and replaceable blade.

5. The arrow of claim 4, wherein the blade is one of plurality of blades.

6. The arrow of claim 5, wherein all the blades of the plurality are identical blades.

7. The arrow of claim 3 wherein the blade, subsequent to initial entry into a target or wildlife game, parts the target or wildlife game by a slicing action, such that minimal energy is expended, thereby conserving remaining energy to be spent in carriage of the arrowhead past initial parted surfaces resulting from the slicing action and deep into the target or wildlife game.

8. An arrowhead comprising:

a. a round and partially tapered body, the round and partially tapered body of the arrowhead having from front to rear, a three sided chisel tip adjoining a first nontapered section, which first nontaper section adjoins a tapered section, the tapered section adjoining a second nontapered section, the second nontapered section being slightly larger than the first nontapered section and an adjoining rearwardly extending threaded section, the threaded section allowing connection to an arrow shaft;

b. three undercut bevels at a rearward edge of the three sided chisel tip;

c. three slots extending along the tapered section and continuing through the second nontapered section, the three slots aligning with the three undercut bevels at the rearward edge of the three sided chisel tip and separated from the three undercut bevels by the first nontapered section of the round and partially tapered body;

d. three identical blades fittingly accommodated by the three slots, each blade of the three blades having a tip secured in the undercut bevel aligned with the slot fittingly accommodating the blade and each blade having a mounting tab positioned in the slot in the second nontapered portion; and, e. a mounting ferrule, the mounting ferrule sized to capture the three mounting tabs within the three slots in the second nontapered section, such that the three identical blades are secured when the threaded section is engaged with an arrow shaft and the mounting ferrule is located over and about the mounting tabs and interposed between the tapered section and an arrow shaft.

* * * * *